US010092783B2

(12) United States Patent
Werz

(10) Patent No.: US 10,092,783 B2
(45) Date of Patent: Oct. 9, 2018

(54) OPERATING HANDLE FOR AN AVALANCHE RESCUE SYSTEM, FUNCTIONAL UNIT OF AN AVALANCHE RESCUE SYSTEM AND AVALANCHE RESCUE SYSTEM

(71) Applicant: Matthias Werz, Engstingen (DE)

(72) Inventor: Matthias Werz, Engstingen (DE)

( * ) Notice: Subject to any disclaimer, the term of this patent is extended or adjusted under 35 U.S.C. 154(b) by 0 days.

(21) Appl. No.: 15/503,748

(22) PCT Filed: Aug. 13, 2015

(86) PCT No.: PCT/EP2015/068664
§ 371 (c)(1),
(2) Date: Feb. 14, 2017

(87) PCT Pub. No.: WO2016/023983
PCT Pub. Date: Feb. 18, 2016

(65) Prior Publication Data

US 2017/0274229 A1 Sep. 28, 2017

(30) Foreign Application Priority Data

Aug. 14, 2014 (DE) ..... 10 2014 111 655

(51) Int. Cl.
*A62B 33/00* (2006.01)
*A63B 29/02* (2006.01)
*A45F 3/14* (2006.01)

(52) U.S. Cl.
CPC ..... *A62B 33/00* (2013.01); *A45F 3/14* (2013.01); *A63B 29/021* (2013.01); *A45F 2003/146* (2013.01)

(58) Field of Classification Search
CPC .... B63C 9/00; A62B 7/00; A62B 7/02; A62B 33/00; A62B 29/021; A45F 3/14
USPC ..... 441/80; 128/202.13, 205.12, 205.21, 128/205.24, 207.14, 207.16
See application file for complete search history.

(56) References Cited

U.S. PATENT DOCUMENTS

| | | | |
|---|---|---|---|
| 4,114,561 | A | 9/1978 | Asaro |
| 4,365,628 | A | 12/1982 | Hodel |
| 6,270,386 | B1 | 8/2001 | Visocekas |
| 6,412,482 | B1 | 7/2002 | Rowe |
| 7,047,966 | B2 | 5/2006 | Stewart |
| 7,984,711 | B2 | 7/2011 | Schipper et al. |
| 2009/0173342 | A1 | 7/2009 | Hamilton |

(Continued)

FOREIGN PATENT DOCUMENTS

| | | |
|---|---|---|
| AT | 291006 | 6/1971 |
| CH | 607926 | 12/1978 |
| DE | 29609433 | 8/1996 |

(Continued)

OTHER PUBLICATIONS

European Office Action in EP 15750997.7 dated Feb. 8, 2018 with English translation of relevant parts.

*Primary Examiner* — Lars A Olson
(74) *Attorney, Agent, or Firm* — Collard & Roe, P.C.

(57) ABSTRACT

An operating handle for an avalanche rescue system, with at least one functional element, is arranged to be coupled to the at least one functional element of the avalanche rescue system. The operating handle is used to trigger the functional element. The operating handle is designed on one end as a mouthpiece or embodies such a mouthpiece. The mouthpiece of the operating handle can be coupled to a ventilation functional unit.

26 Claims, 10 Drawing Sheets

(56) References Cited

U.S. PATENT DOCUMENTS

2009/0239428 A1 9/2009 Berchten

FOREIGN PATENT DOCUMENTS

| | | | |
|---|---|---|---|
| DE | 29709269 | | 8/1997 |
| DE | 20203685 | | 7/2003 |
| EP | 0931567 | | 7/1999 |
| EP | 1171204 | | 1/2002 |
| WO | 2005/109982 | A2 | 11/2005 |
| WO | 2007/129014 | A1 | 11/2007 |
| WO | WO 2013/059949 | | 5/2013 |

OPERATING HANDLE FOR AN AVALANCHE RESCUE SYSTEM, FUNCTIONAL UNIT OF AN AVALANCHE RESCUE SYSTEM AND AVALANCHE RESCUE SYSTEM

CROSS-REFERENCE TO A RELATED APPLICATION

The invention described and claimed hereinbelow is a National Stage Application of PCT/EP2015/068664, filed on Aug. 13, 2015 (the PCT application), now filed in the United States under 35 USC § 371. The PCT application claims priority from German Patent Application DE 10 2014 111655.0, filed on Aug. 14, 2014. The contents of the PCT application and the German Patent Application are incorporated by reference herein. The PCT application provides the basis for a claim for priority of invention.

BACKGROUND OF THE INVENTION

The invention relates to an operating handle for an avalanche rescue system, a functional unit of an avalanche rescue system comprising at least two functional elements which are coupled via a triggering system to an operating handle according to the invention, and an avalanche rescue system.

Many people die every year as a result of avalanches. Persons who engage in sporting activities in unsafe alpine environments are particularly affected. In order to increase the chances of survival of these persons, emergency systems designed to increase the chances of survival have been developed. For example, it is known to provide an inflatable buoyant element, which is similar to an airbag, on an emergency system. A user can trigger the inflation of the buoyant element in order to thereby increase his surface area. As a result, it is possible for the winter sports enthusiast, who has triggered the buoyant element, to move upward in the avalanche and thereby avoid being buried too deep.

It is also known to provide a balloon which is inflated in an emergency and is likewise supposed to float upward, and therefore the buried winter sports enthusiast, who is connected to the balloon, can be found. Such a system is known, for example, from EP 0 931 567 A2. The problem with this system is that, on the one hand, the operating handle for triggering the functional elements (buoyant element and balloon) is disposed in an ergonomically unfavorable manner. A further disadvantage of this system is that a buried winter sports enthusiast can suffocate, since there is no way to ventilate the winter sports enthusiast.

SUMMARY OF THE INVENTION

The problem addressed by the present invention is that of providing a system, by means of which the chances of survival of a winter sports enthusiast who has been buried by an avalanche are increased.

This problem is solved according to the invention by an operating handle for an avalanche rescue system, which can be coupled to at least one functional element of the avalanche rescue system and by means of which a functional element can be triggered, wherein the handle is designed on one end as a mouthpiece or comprises such a mouthpiece, which can be coupled to a ventilation functional unit. The operating handle can therefore be used, on the one hand, for triggering the ventilation functional unit. On the other hand, the handle can be used for ventilating a buried winter sports enthusiast. Given that the mouthpiece is integrated into the handle, a winter sports enthusiast only needs to carry out one movement in order to trigger the ventilation functional unit and guide the mouthpiece into the oral cavity. While it was provided according to the prior art, under certain circumstances, that a mouthpiece must be guided into the oral cavity and that a functional element must be triggered, only one single hand motion is therefore necessary in this case. The functional element can be triggered by moving the mouthpiece toward the mouth. A winter sports enthusiast therefore only needs to concentrate on one single operation and does not need to carry out several hand motions. The chances of survival of a buried winter sports enthusiast can therefore be substantially improved.

The mouthpiece can be formed from a material having limited resilience, and therefore a user can bite into the mouthpiece without being able to fully compress it.

According to one embodiment, the handle can be designed to be substantially T-shaped, wherein an air channel extends in one leg. If the handle is designed to be substantially T-shaped, it can be more easily gripped. For example, one leg of the "T" can be gripped with the index finger and the other leg of the "T" can be gripped with the middle finger and the ring finger. Preferably, the region having the two legs of the "T" are angled with respect to a third base leg. The ergonomics are improved as a result.

Given that one leg comprises an air channel, the handle can be breathed through and the ventilation function can be implemented.

The mouthpiece can be connected to the operating handle via a flexible connection piece. In particular, the mouthpiece can be pulled slightly away from the handle, which is possible due to the flexible connection piece. The mouthpiece can be displaced or rotated in any way relative to the handle in order to permit the mouthpiece to be moved toward the mouth in an optimal manner. The connection piece can be designed, for example, as a tube, in particular as a bellows-type tube.

In order to prevent injuries in the oral cavity due to a rotation of the triggering handle or a jolt on the triggering handle caused by the avalanche, the mouthpiece is preferably flexibly mounted on the handle. The mouthpiece can be detachably disposed on the handle so that the mouthpiece can be replaced.

Sections of the operating handle can be designed to be hollow. In this case, further components of the avalanche rescue system can be disposed in the operating handle, for example a mechanism for triggering the functional elements.

A tube, which is connected to the ventilation functional unit, can extend, in sections, parallel to one section of the operating handle. For example, the tube can extend, outside of the operating handle, in parallel to one section of the operating handle and then enter the operating handle, and therefore a fluidic connection to the mouthpiece is established.

Alternatively, it can be provided that sections of the tube extend in the operating handle. This has the advantage that the tube is disposed in the operating handle in a protected manner. In addition, a connection to the mouthpiece can be easily implemented as a result.

In order to prevent the operating handle or the mouthpiece from becoming clogged by a heavy snowfall, a cover or a cap can be provided for covering the mouthpiece as necessary. The functional reliability can be increased as a result.

Further advantages result when fastening means are provided for detachably fastening the handle to a carrier system. For example, the fastening means can be provided for fastening the handle on a carrier belt of a backpack. This has the advantage that the handle only needs to be disposed on the carrier system as needed. In particular, it can be provided that a backpack, in which the functional elements of the avalanche rescue system are disposed, can be separated from the avalanche rescue system and, for example, can be used in the summer without the avalanche rescue system. For this purpose, it is advantageous if the operating handle can be released from the carrier system. The fastening can take place via a locking joint. This locking joint can comprise suitable grooves, by means of which the locking joint can be placed on piping on a carrier belt. With this type of fastening, the handle can also be displaced along the carrier belt so that the handle can be positioned in a manner which is optimal for a user.

In addition, it can be provided that the operating handle can be fixed in the region of the chest of a user. In particular, a breastplate can be provided, on which the operating handle can be fastened.

It is particularly advantageous if at least one section of the operating handle is designed to be length-adjustable, in particular, telescopic. As a result, it is possible to keep the handle relatively small when it is clear that it will not be needed. On the other hand, the handle can be extended and thereby enlarged, so that the handle can be more securely gripped. The extended position is therefore preferably assumed when the winter sports enthusiast enters an avalanche-prone region.

Further advantages result when a fixing mechanism is provided for fixing the handle in a length-adjusted position. In particular, it can be provided that the handle, in its lengthened position, is automatically fixed in this position. The fixing can take place in such a way that a user receives haptic feedback that the handle has been fixed in its lengthened position. The handle can be fixed in its different positions on the breastplate, e.g., by means of velcro fasteners.

It is particularly advantageous if at least one opening is provided on the handle, through which used respiratory air can escape. In particular, it can be provided that respiratory air and expired respiratory air can be guided separately, in order to prevent mixing.

The operating handle can comprise multiple parts, wherein at least one part is removable. The ventilation tube can also be detachably connected to the removable part.

In order to increase the functional reliability, it can be provided that at least some sections of the surface of the operating handle are designed to have increased static friction. For example, the surface of the operating handle can be rubberized. Alternatively, it is conceivable that the surface of the operating handle comprises one part of the velcro fastener. In this case, the operating handle can comprise either a fleece strip or a hook strip, while the counterpart, i.e., the fleece strip or the hook strip, can be provided on a glove of a user. A triggering of the functional element can therefore be ensured even if the operating handle is gripped in an imprecise or hectic manner. The situation in which a user slips on the operating handle is prevented.

The scope of the invention also covers a functional element of an avalanche rescue system comprising at least two functional elements, which are coupled via a triggering system to an operating handle according to the invention and can be triggered simultaneously by operating the operating handle. One of the functional elements is a ventilation functional unit. Thus, multiple functional elements can be simultaneously triggered, wherein the mouthpiece on the operating handle is guided to the mouth in the instant at which the functional element is triggered by the user. Thus, only one single movement is necessary to both trigger the functional elements and guide the operating handle to the mouth. The functional reliability of an avalanche rescue system is thereby increased.

The triggering system can include a control cable which branches, at one end, into strands which lead to the individual functional elements. Such a control cable can be coupled, at its non-branched end, to the operating handle. Preferably the control cable comprises a casing which is stiff in the longitudinal direction, and therefore a Bowden cable is implemented.

Alternatively, it is conceivable that a number of control cables corresponding to the number of functional elements is provided, the control cables being coupled to the operating handle. Such a triggering system is more functionally reliable, under certain circumstances. If one of the control cables should tear, the other functional elements, which are connected to the other control cables, can nevertheless be triggered. If the non-branched control cable in the alternative embodiment tears, however, no functional element can be triggered, under certain circumstances.

Some sections of at least one control cable and one ventilation tube can be routed in parallel and enclosed by an insulation casing. As a result, they are disposed in a protected manner. The control cable can be a component of an electronic triggering system. Alternatively, it is conceivable that an activation cord is provided for electronically triggering at least one functional element, in addition to or as an alternative to the control cable.

According to one advantageous embodiment of the invention, it can be provided that the functional elements are a ventilation functional unit, a buoyant-element functional element, and a position-finding functional element comprising a balloon. Thus, three functional elements are combined in one functional element. This has not been known, up to now, from the prior art. Every single one of these functional elements increases the chances of survival of a buried winter sports enthusiast. The buoyant element can preferably be designed, in this case, in such a way that the buoyant element, after having been inflated, is wider than the shoulders of a buried person. In addition, the buoyant element can be shaped in such a way that the buoyant element protects and stabilizes the neck region of a winter sports enthusiast, in order to prevent injuries to the spinal column.

The balloon can be preferably fastened to an, in particular, elastic cord which has been wound onto a pulley. The pulley is preferably fastened to the user or to a carrier system in this case. Given that the cord has been wound onto the pulley, an uninterrupted unwinding can be ensured. The situation in which the cord gets tangled up can also be prevented.

The cord for the balloon can be marked with colors. For example, three different colors can be provided. On the basis of the color marking, a rescue team can determine how deeply buried the accident victim is.

Particular advantages result when the functional elements are disposed on a functional element carrier which can be disposed in a carrier system, in particular in a backpack. As a result, a defined space is provided for each functional element. The functional reliability can be increased as a result. In addition, the entire functional element carrier, including the functional elements, can be easily removed from a backpack or placed therein. A backpack can therefore also be used in the summer, for example, after the functional element carrier has been removed.

The functional element carrier can have recesses at least for components of the functional elements. As a result, the components of the functional elements are also disposed in a protected manner.

The functional element carrier can have a recess for a probe and/or an avalanche shovel. Thus, elements are also provided on the functional element carrier, which a winter sports enthusiast can use in order to locate and rescue other accident victims.

The buoyant element is preferably connected to the functional element carrier. In addition, fastening means can be provided for detachably fastening the functional element carrier in a carrier system, in particular a backpack. By means of the fastening system, the functional element carrier can be fixedly connected to the backpack. A connection to the user is therefore established via the backpack.

An avalanche rescue system comprising a functional unit according to the invention also falls within the scope of the invention.

Further features and advantages of the invention result from the detailed description of exemplary embodiments of the invention that follows, with reference to the figures in the drawing which shows the details that are essential to the invention. Further features and advantages of the present invention also result from the claims.

The features described therein are not intended to be interpreted literally, and are presented in such a manner that the special features of the present invention may be presented clearly. The various features can be implemented individually, or these can be combined in any possible manner in different variants of the invention.

Exemplary embodiments of the invention are depicted in the schematic drawing, in various stages of use, and are described in greater detail in the description that follows.

DETAILED DESCRIPTION OF THE INVENTION

Figure 1:
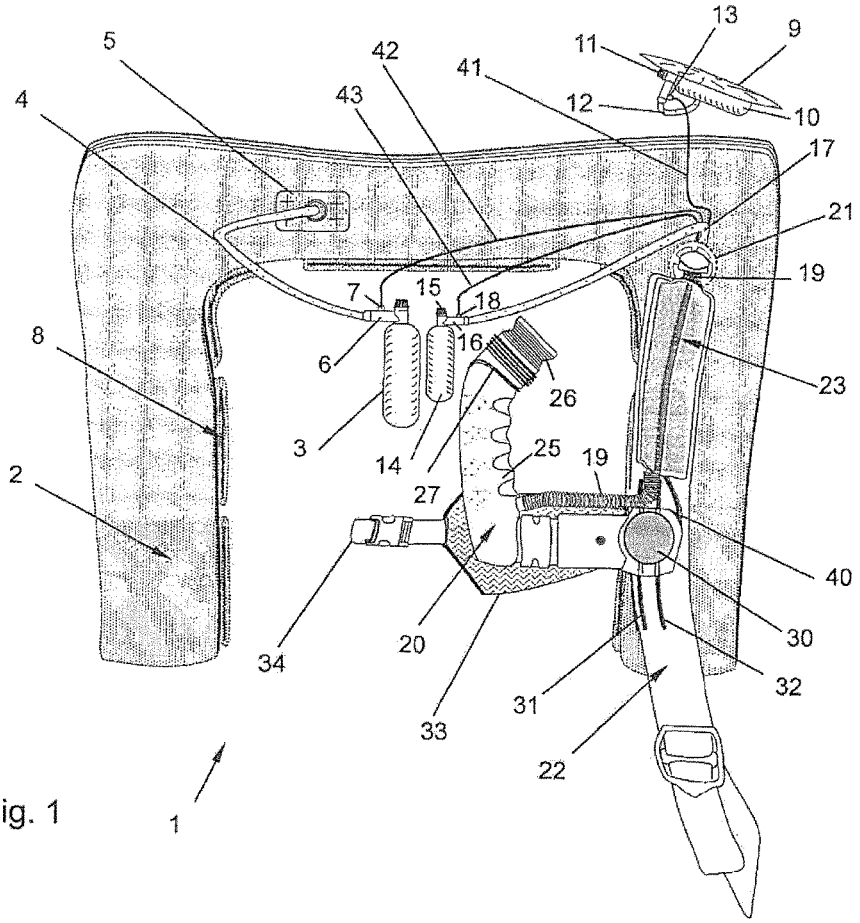
FIG. 1 shows a schematic illustration of a functional unit.

FIG. 1 shows a schematic illustration of a functional unit 1 of an avalanche rescue system. The functional unit 1 comprises a first functional element which comprises a buoyant element 2, a gas cartridge 3, and a gas line 4 connecting the gas cartridge 3 to the buoyant element 2. The gas line 4 leads into a connection piece 5. The gas cartridge 3 is connected to the gas line 4 via a pressure control valve 6. In addition, a securing pin 7 is provided, which is connected to a triggering system which will be described in greater detail.

The buoyant element 2 comprises connection tabs 8, by means of which the buoyant element can be connected to a functional element carrier which will be described. In the illustration shown, the buoyant element 2 is folded and compressed.

A second functional element comprises a balloon 9 and a gas cartridge 10 which is connected to the balloon 9 via a valve 11 and a gas line 12. The valve 11 likewise comprises a securing pin 13 which is connected to a triggering system.

The gas in the cartridge 10 is preferably lighter than air. The pressure of the outflowing gas is controlled by the valve 11. A check valve is located on the underside of the balloon 9. This valve prevents a reverse flow of the gas and ensures that all of the gas contained in the cartridge 10 is dispensed into the tear-proof balloon 9. The balloon 9 is connected to an elastic cord which is marked with colors and is not shown here. The elastic cord has been wound onto a pulley which is connected to a functional element carrier which will be described further below. This pulley is characterized in that it allows for a lengthening as well as a shortening of the cord. A danger posed to the user by the cord is thereby prevented. The cord has a color scale which subdivides the cord into three regions without indicating the metric distance to the buried person. This means that, in order to exactly determine the position of the buried person, a pinpointing of the location must be carried out using an avalanche probe, and risky misinterpretations of the distance must be avoided, which can occur if a metric scale is used. The use of an elastic material for the cord prevents a possible injury in the neck region of the buried person. Given that the balloon is filled with a gas that is lighter than air, an independence from the principle of inverse segregation is made possible and, as a result, the localization of a buried person is improved.

A further functional element which is provided is a ventilation functional unit which comprises a gas cartridge 14 containing liquid oxygen. The gas cartridge 14 is connected to a tube 17 via a valve 15 and a vaporizer 16 which also functions as a pressure regulator. In addition, a securing pin 18, which is likewise connected to a triggering system, is provided on the vaporizer 16.

The tube 17 is routed through an adjustable-length protective sleeve 19 to an operating handle 20. The protective sleeve 19 is designed in the form of a bellows in order to enable the length to be adjusted. The protective sleeve 19 is fixed at a fixing point 21. The tube 17 or the protective sleeve 19 is routed in an insulation casing 23 along a carrier belt 22 designed as a shoulder belt. The insulation casing can be formed from Neoprene, for example. The tube 17 is routed within the protective casing 19 in parallel to sections of the operating handle 20. The tube then leads into a hollow part 25 of the operating handle 20, on the end of which a mouthpiece 26 is provided. The mouthpiece 26 is made of a flexible material in order to protect the oral cavity of a user. The flexible material cannot be compressed to the extent that gas no longer flows through. Openings 27 are provided below the mouthpiece 26, through which expired respiratory air, in particular $CO_2$, can flow out.

The operating handle 20 is fastened to a carrier system, in particular to the carrier belt 22, via a locking joint 30. By means of the locking joint 30, the position of the operating handle 20 can be adjusted, in particular pivoted. The locking joint 30 comprises grooves on the back side thereof, which interact with corresponding pipings 31, 32 in order to fasten the locking joint 30 and, therefore, the handle 20, thereon. The height of the operating handle 20 can also be adjusted along the pipings 31, 32.

When a triggering is carried out, one part 25 of the operating handle 20 is triggered or torn off, and therefore the operating handle 20 can be guided to the mouth of the user, and the user can receive the mouthpiece 26 in the mouth. The protective casing 19 can expand in this case. The length of the tube 17 is sized in such a way that a guidance to the mouth of the user is easily possible. Alternatively or additionally, the tube 17 can also be designed to be length-adjustable.

The operating handle 20 can be fastened on a locking plate 33 which is designed as a breastplate. The locking plate 33 can be fastened on a chest belt 34.

A triggering system 40 is provided for triggering the functional elements, which, in the exemplary embodiment shown, comprises a control cable or a Bowden cable (see Hg. 5 for details) which branches at the top into strands 41, 42, 43 which extend to the securing pins 7, 13, 18. If the operating handle 20 is pulled, the securing pins 7, 13, 18 are therefore pulled out, and therefore gas can flow out of the corresponding cartridges 3, 10, 14.

The functional elements are therefore simultaneously triggered. If a person becomes buried, not only is a visual position-finding function made possible, but the supply of respiratory air to the buried person is ensured. In this context, the short time window between the triggering of a snow slab and the instant in which the winter sports enthusiast is caught by the avalanche requires that the operating handle 20 be guided to the mouth of the buried person as quickly as possible. A triggering of the functional elements is automatically implemented when this guidance is carried out. If a functional element were to malfunction, two further functional elements are still available, which increases the chances of survival for a buried person.

Figure 2:
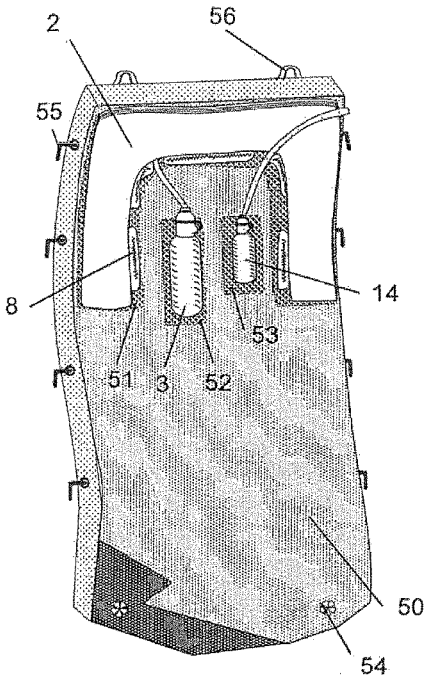
FIG. 2 shows a functional element carrier, on which parts of the functional unit are disposed.
Figure 3:
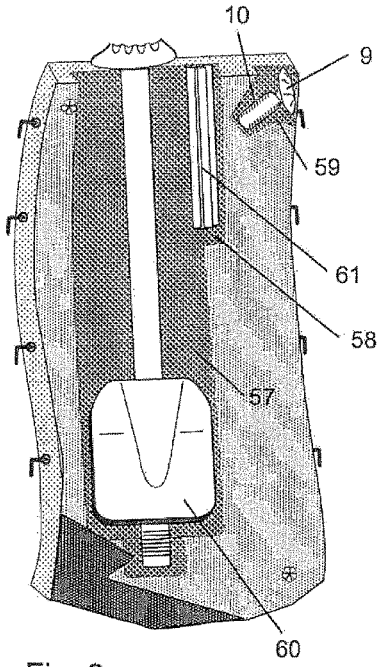
FIG. 3 shows a cross section of the functional element carrier for visualizing further functional elements provided on the functional element carrier.

FIG. 2 shows a functional element carrier 50 which can be designed as a foam plate. The functional element carrier 50 has recesses 51, 52, 53 in which components of the functional elements are disposed. In this case, the buoyant element 2 is fixedly connected to the functional element carrier 50 via connection tabs 8. The functional element carrier 50 has through-passages 54, through which, for example, parts of the triggering system can be routed. The functional element carrier 50 can be detachably connected via a fastening means 55 to a carrier system, for example, a backpack. Gripping tabs 56 can be provided on the upper end in order to facilitate the removal of the functional element carrier 50. FIG. 3 shows a cross section of a further plane of the functional element carrier 50. In this case it is apparent that further recesses 57, 58, 59 are provided, in which an avalanche rescue shovel 60, an avalanche rescue probe 61, and the cartridge 10 and the balloon 9 are disposed.

Figure 4:
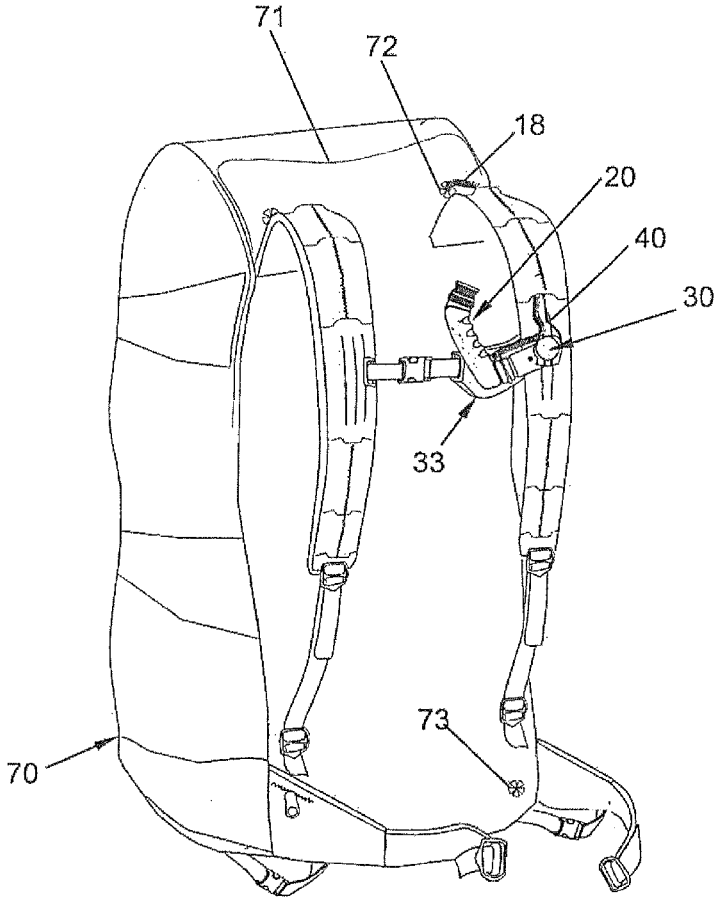
FIG. 4 shows a view of a carrier system on which a functional unit is disposed.

FIG. 4 shows a carrier system 70 which is designed as a backpack in which the functional element carrier 50 is disposed. It is apparent that an opening 71 for the buoyant element 2 is provided on the carrier system 70. This opening 71 can be closed, for example, by means of a velcro closure which automatically opens when the buoyant element 2 is filled with gas. In addition, a through-passage 72 for the protective casing 18, including the tube 17 and the triggering system, is apparent. In principle, it is also conceivable to route the tube 17, including the protective casing 18, out of the carrier system 70 through a lower through-passage 73. Previously described elements are labeled using the previously used reference numbers.

Figure 5:
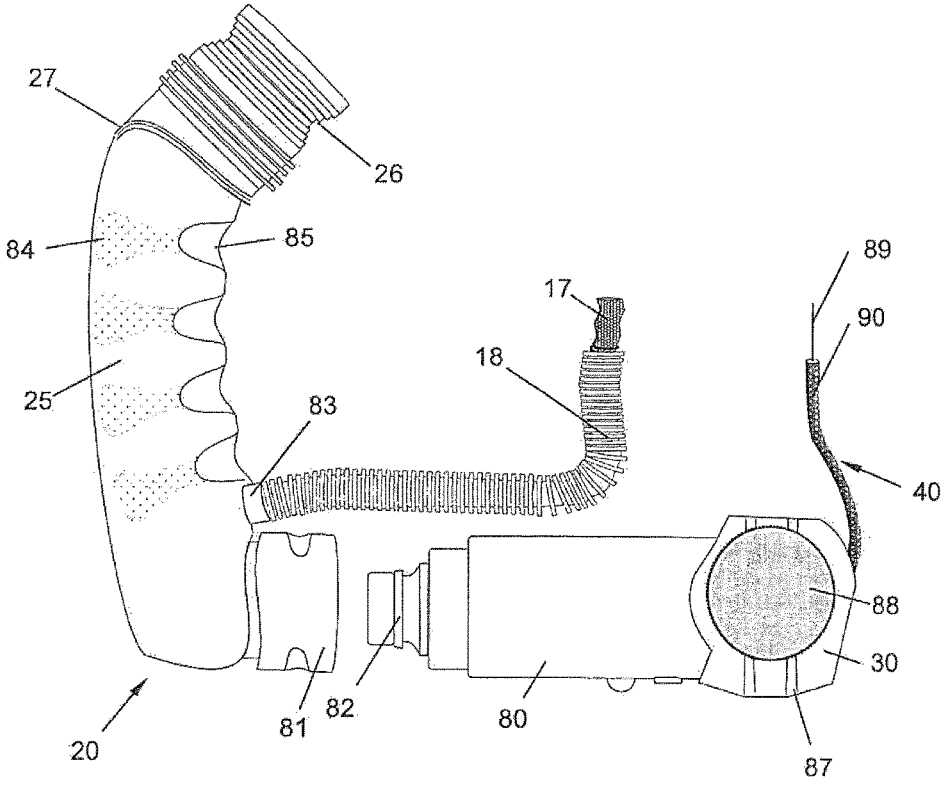
FIG. 5 shows an operating handle according to the invention.

FIG. 5 shows a detailed illustration of the operating handle 20. In particular, it is apparent that the hollow part 25 of the operating handle 20 can be separated from the adjustable-length part 80. Given that the part 25 is removable, an erroneous triggering of the functional elements can be prevented. It can be necessary, for example, when traveling in a gondola, to remove the operating handle 20 in such a way that an erroneous triggering can be avoided. A sliding element 81 can therefore be provided on the handle 25, by means of which an interlocking with the plug-in part 82 can be triggered. On the other hand, the handle 25 can be easily installed on the plug-in part 82 in order to connect the two handles 25, 80 to one another. In the region of the sliding element 81, the handles 25, 80 can be separated/torn apart during a triggering.

The tube 17, including the protective casing 19, can also be detachable from the handle 25 at the point 83, but it must not detach during a triggering of the functional elements, of course. The handle 25 can be provided with increased static friction 84 on its surface and, for example, can be rubberized. The handle can also be provided with recesses 85 which facilitate a reliable grip.

It is also apparent that the tube 17 is designed in the shape of a "Z". It is therefore length-adjustable. It is therefore ensured that the tube 17 can be lengthened so far that a reliable guidance of the mouthpiece 26 to the mouth of a user is possible. The protective casing 19 is also length-adjustable.

The locking joint 30 has grooves 87 on both sides (front side and back side). As a result, the locking joint can also be mounted on the other side of a carrier system. The grooves 87 can be covered by a faceplate 88.

It is also apparent that the triggering system 40 comprises a control cable 89 and a casing 90. The triggering system 40 therefore comprises a Bowden cable.

Figure 6:
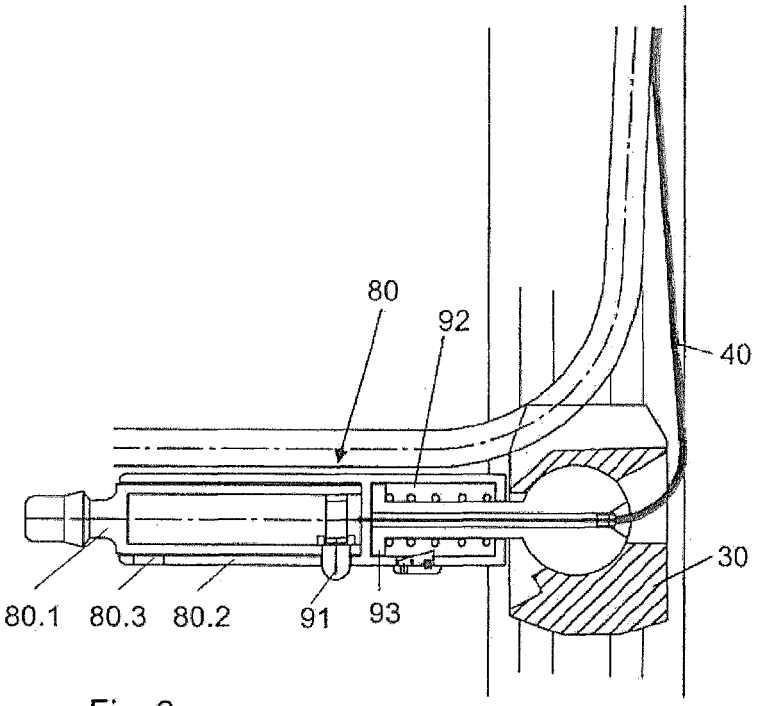
FIG. 6 shows one part of the operating handle in a non-triggered position.

FIG. 6 shows a cross section of the part 80 of the operating handle 20. It is apparent here that the triggering system 40 has been routed into the locking joint 30 and connected to a telescopic part 80.1. The telescopic part 80.1 is routed inside the telescopic part 80.2. In the position shown, the telescopic part 80.1 is fixed in the telescopic part 80.2 by means of the pushbutton 91 which extends through an opening in the telescopic part 80.2. The length of the part 80 is changed by pressing the pushbutton 91 and displacing the telescopic part 80.1 relative to the telescopic part 80.2 until the pushbutton is locked in the opening 80.3. The state in which the length has been changed is therefore fixed.

The triggering of the functional elements takes place against the restoring force of a spring element 92 which bears, at one end, against the telescopic part 80.1 and, at the other end, against an extension 93 of the locking joint 30. The restoring force is advantageously greater, in this case, than the force required for (forcefully) tearing the handle 25 off of the handle 80.

Figure 7:
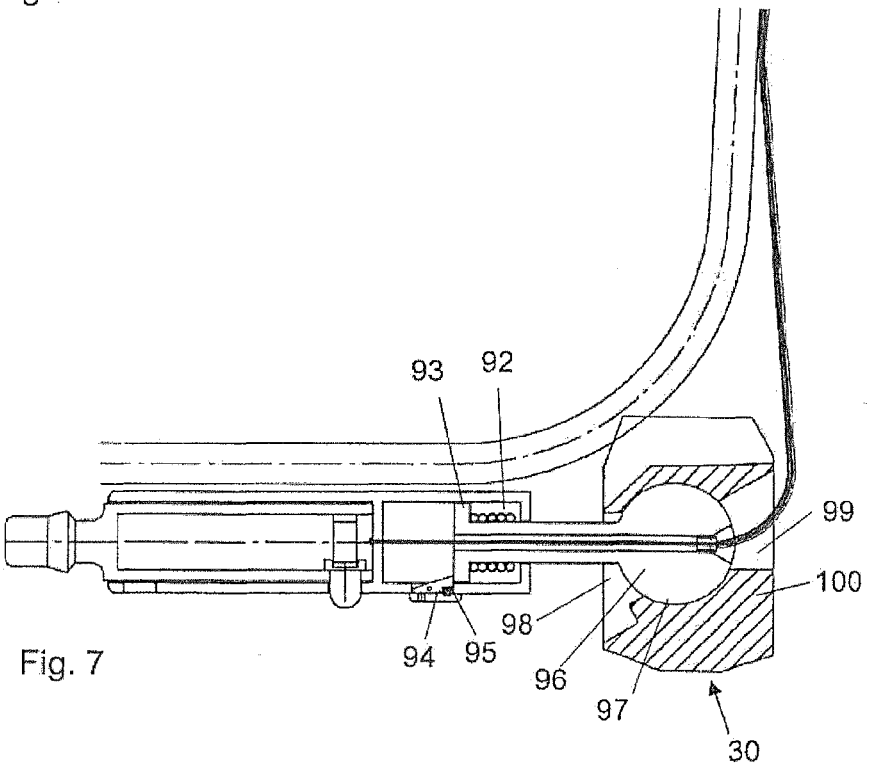
FIG. 7 shows one part of the operating handle in a triggered position.

If the part 80 is pulled to the left, the situation shown in FIG. 7 results. The spring element 92 was compressed and the catch 94 engages behind the extension 93 of the locking joint 30. The catch 94 is deflected by a small spring element 95, and therefore an automatic interconnection takes place when the part 80 of the operating handle 20 is pulled to the left. This interlocking is noticeable by a user, and therefore haptic feedback is provided. In this situation, the functional elements are triggered (the cord 89 has been pulled to the left). The triggered position is locked in place by the catch 94. The catch 94 can be released again by means of a sharp object.

It is also apparent that the locking joint 30 comprises a ball 96 which can be moved into a cup 97. Recesses 98, 99 in the fixed part 100 of the locking joint 30 allow for a pivot movement without adversely affecting the function of the operating handle 20. Instead of a ball 96, a disk could be simply provided, although only limited pivotability could then be implemented.

Figure 8:
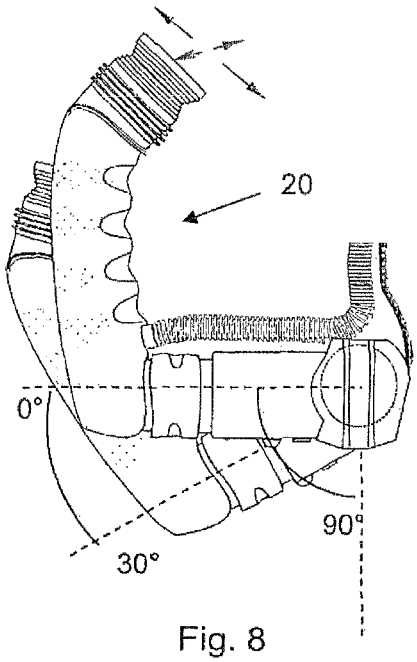
FIG. 8 shows an illustration for describing the displaceability of the operating handle.

FIG. 8 shows the region in which the operating handle 20 can be displaced with respect to the horizontal plane of the body. As a result, a user can select the optimal angle. In particular, a pulling angle of the operating handle 20 can be set in the range of 0°-30° with respect to the horizontal plane of the body. The adjustable pulling angle supports the ergonomics of the triggering and can prevent an erroneous gripping of the operating handle 20.

Figure 9:
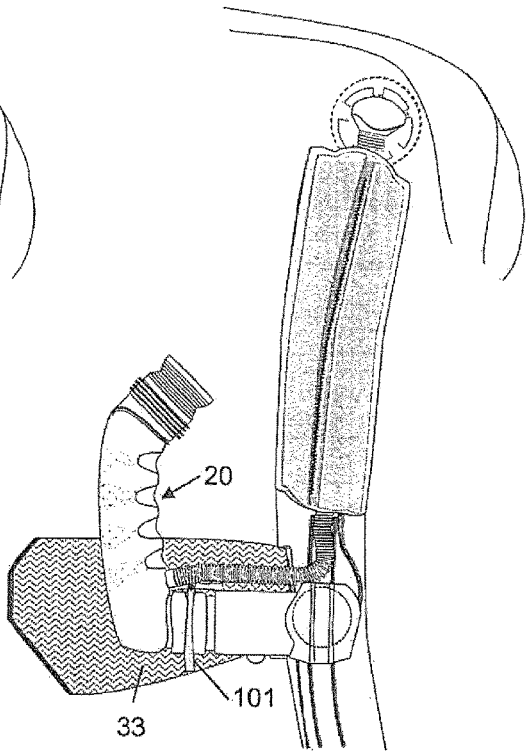
FIG. 9 shows an illustration for describing the locking of the operating handle in the retracted state.

As shown in the illustration in FIG. 9, the operating handle 20 can be locked in the retracted state on the locking plate 33 by a locking means 101, such as, for example, a velcro fastener.

Figure 10:
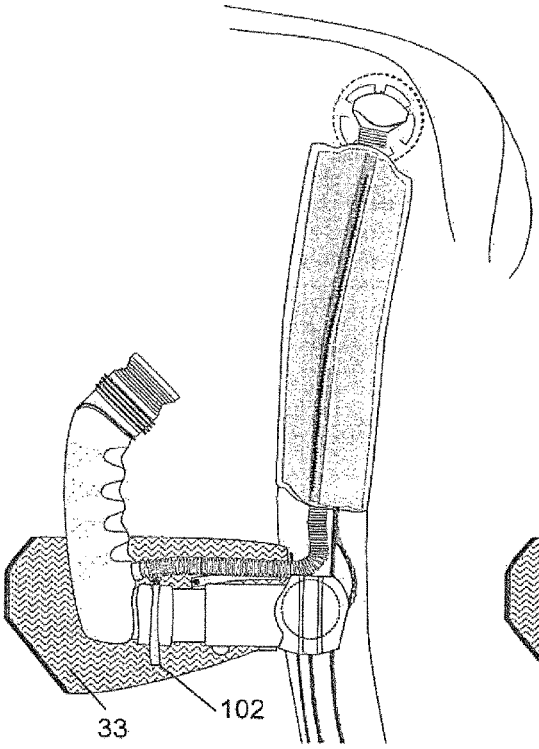
FIG. 10 shows an illustration of the operating handle in the locked, extended state.

As shown in FIG. 10, a locking in the extended state of a breast plate 33 is also possible by means of a further locking means 102.

Figure 11:
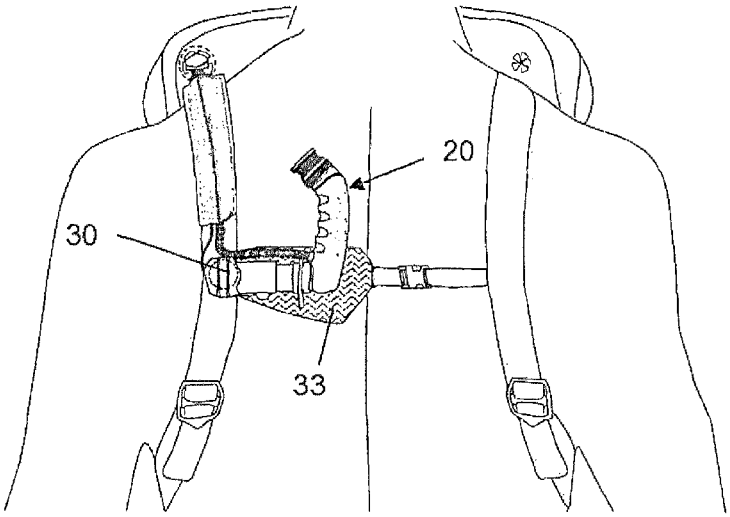
FIG. 11 shows an illustration in which the operating handle is disposed on the right side of the user.

While the use of the operating handle 20 on the left side—as viewed from the user—was depicted in the previous illustrations, FIG. 11 shows that the operating handle 20 can also be installed on the right side. In particular, the locking plate 33 can be used on the right or left for this purpose. The locking joint 30 can also be fastened on two opposite sides and is designed accordingly. The operating handle 20 according to the invention and the functional unit can therefore be used by right-handed persons as well as left-handed persons.

Figure 12:
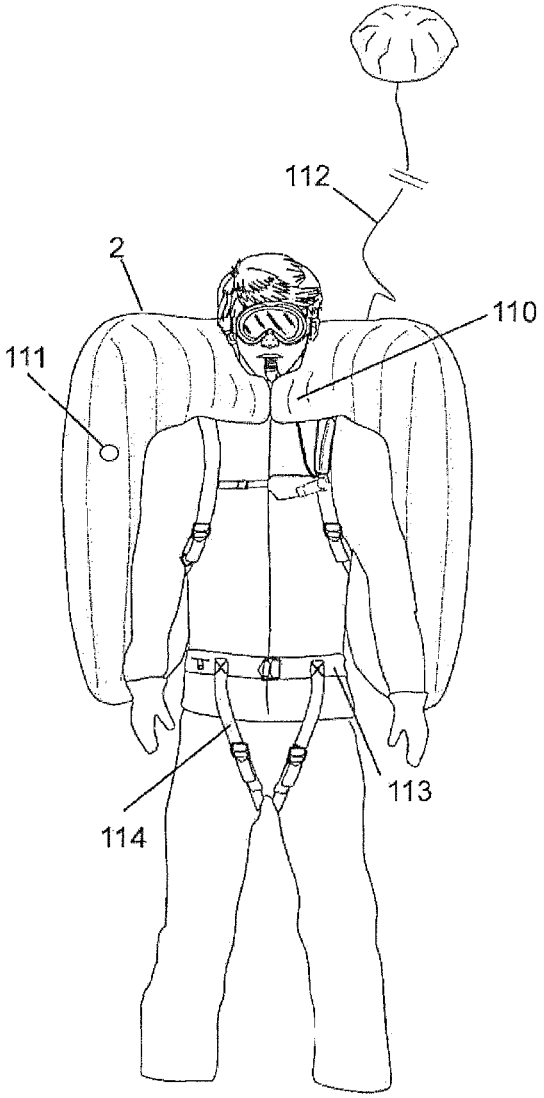
FIG. 12 shows an illustration of the invention during use by a user.

FIG. 12 shows a user who has triggered the functional elements. In particular, it is apparent that the buoyant element 2 has been inflated and is wider than the user. The neck of the user is enclosed by wings 110, and therefore the neck region is protected. In this case, it is apparent that the buoyant element 2 comprises a Venturi tube 111, by means of which it is ensured that the buoyant element 2 will fully inflate. The user has torn the operating handle 20 out of the anchoring on the telescopic part 80 and has inserted the mouthpiece 26 into the mouth. The balloon 9 has been inflated and the cord 112 has been at least partially unwound. In the exemplary embodiment shown, the carrier system comprises not only a hip belt 113 but also leg belts 114.

Figure 13:
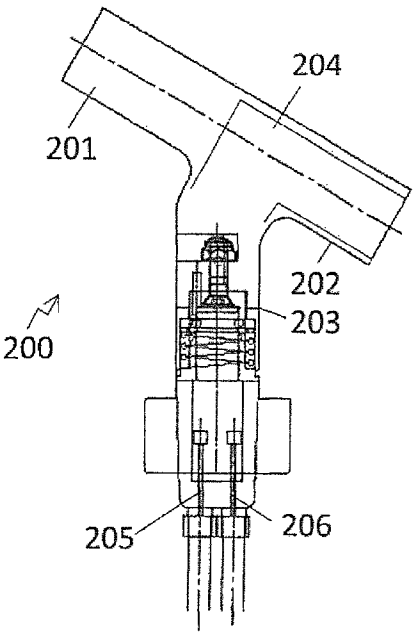
FIG. 13 shows one alternative embodiment of an operating handle.

FIG. 13 shows one alternative embodiment of a handle 200. The handle 200 is designed substantially in the shape of a "T", wherein the legs 201, 202 are angled with respect to a base leg 203. In particular, the leg 202 has an angle, with respect to the base leg 203, of less than 90°, and the leg 201 has an angle, with respect to the base leg 203, of more than 90°. An air channel 204 is formed in the leg 202, by means of which the ventilation function can be implemented. The handle 200 is therefore designed hollow in sections. A mouthpiece, which will be described in greater detail, can be connected to the leg 202. It is also apparent that two control cables 205, 206 designed as Bowden cables are disposed on the handle 200. Both control cables 205, 206 or only one thereof can be connected to the handle 200, as necessary. In particular, the control cables 205, 206 are detachably connected to the handle 200. One of the control cables 205, 206 can also be used, for example, for actuating an electronic actuating mechanism for a functional element. It is likewise conceivable to use an activating cable for an electronic triggering mechanism, instead of one of the control cables 205, 206.

Figure 14B:
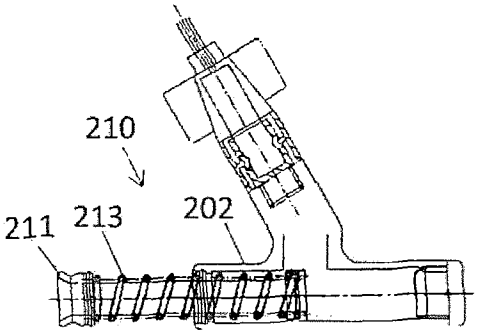
FIG. 14 *a, b* show the operating handle from FIG. 13 comprising a mouthpiece arrangement.
Figure 14A:
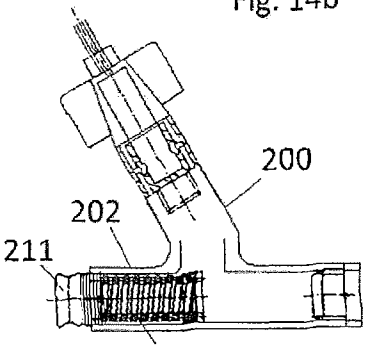

FIG. 14*a* shows a mouthpiece arrangement 210 having a mouthpiece 211 and a connection piece 213 which is disposed on the operating handle 200. The mouthpiece 211 is connected via the flexible connection piece 213 to the operating handle 200, in particular to the leg 202. If an emergency situation occurs and a ventilation function must be implemented, the mouthpiece 211—as shown in FIG. 14*b*—can be moved with respect to the leg 202, in particular can be pulled out slightly. This is possible since the flexible connection piece 213 is utilized. In the present case, the flexible connection piece 213 is designed as a bellows-type tube. The mouthpiece 211 can now be moved and displaced in any way with respect to the leg 202, and therefore the mouthpiece can be moved toward the mouth of a user in an optimal manner.

What is claimed is:

1. An operating handle for use with an avalanche rescue system, configured with at least one functional element that is coupled to the operating handle, wherein the handle is designed on one end as a mouthpiece or comprises such a mouthpiece;

wherein the mouthpiece is configured to be coupled to a ventilation functional unit, and wherein the handle is configured for triggering the functional element by moving the mouthpiece toward a user's mouth.

2. The operating handle according to claim 1, wherein sections of the operating handle are hollow.

3. The operating handle according to claim 1, wherein a tube is connected to the ventilation functional unit, and extends, in sections, parallel to one section of the operating handle.

4. The operating handle according to claim 1, wherein the handle is designed to have multiple parts, and wherein at least one part of the multiple parts is removable.

5. The operating handle according to claim 1, further comprising a cover or a cap for covering the mouthpiece, as necessary.

6. The operating handle according to claim 1, further comprising fastening means for detachably fastening the handle to a carrier system.

7. The operating handle according to claim 1, further comprising a fastening element, wherein the handle is disposed on the fastening element so as to have limited pivotability.

8. The operating handle according to claim 1, further comprising at least one section designed to be length-adjustable.

9. The operating handle according to claim 1, further comprising a fixing mechanism for fixing the handle in a length-adjusted position.

10. The operating handle according to claim 1, further comprising at least one opening through which expired respiratory air can escape.

11. The operating handle according to claim 1, wherein at least sections of a surface of the operating handle are designed to have increased static friction.

12. The operating handle according to claim 1, wherein the handle is substantially T-shaped, and wherein an air channel extends in one leg.

13. The operating handle according to claim 1, wherein the mouthpiece is connected to the operating handle via a flexible connection piece.

14. A functional unit of an avalanche rescue system, comprising:

an operating handle;

a triggering system; and at least two functional elements coupled via the triggering system to the operating handle;

wherein the handle is designed on one end as a mouthpiece or comprises a mouthpiece;

wherein the mouthpiece can be coupled to a ventilation functional unit;

wherein the at least two functional elements are simultaneously triggered by; by moving the mouthpiece toward a user's mouth.

15. The functional unit according to claim 14, wherein the triggering system includes a control cable that branches, at one end, into strands that lead into the at least two functional elements.

16. The functional unit according to claim 14, further comprising a number of control cables corresponding to a number of functional elements, wherein the control cables are coupled to the operating handle.

17. The functional unit according to claim 14, wherein some sections of at least one control cable and one ventilation tube are routed in parallel and are enclosed by an insulation casing.

18. The functional unit according to claim 14, wherein the at least two functional elements comprise any of a ventilation functional unit, a buoyant-element functional unit, and a position-finding functional unit comprising a balloon.

19. The functional unit according to claim 18, wherein the balloon is fastened to a cord that is wound onto a pulley.

20. The functional unit according to claim 19, wherein the cord of the balloon is marked with colors.

21. The functional unit according to claim 14, wherein the at least two functional elements are disposed on a functional element carrier, and wherein the functional element carrier can be disposed in a carrier system.

22. The functional unit according to claim 21, wherein the functional element carrier has recesses at least for components of the at least two functional elements.

23. The functional unit according to claim 21, wherein the functional element carrier includes a recess for a probe, a recess for an avalanche shovel, or recesses for both a probe and an avalanche shovel are provided on the functional element carrier.

24. The functional unit according to claim 21, wherein a the buoyant element is connected to the functional element carrier.

25. The functional unit according to claim 21, further comprising fastening means for detachably fastening the functional element carrier in a carrier system.

26. An avalanche rescue system comprising;

a functional unit according to claim 14; and a carrier system;

wherein the functional unit is disposed in or on the carrier system.

* * * * *